United States Patent [19]

Nagashima

[11] Patent Number: 4,702,139

[45] Date of Patent: Oct. 27, 1987

[54] CHAIN WITH CUTTING TEETH

[75] Inventor: Akira Nagashima, Kawasaki, Japan

[73] Assignee: Kioritz Corporation, Tokyo, Japan

[21] Appl. No.: 848,856

[22] Filed: Apr. 4, 1986

[30] Foreign Application Priority Data

Apr. 24, 1985 [JP] Japan ..... 60-61521[U]

[51] Int. Cl.[4] ..... B27B 33/14

[52] U.S. Cl. ..... 83/830

[58] Field of Search ..... 83/830–834

[56] References Cited

U.S. PATENT DOCUMENTS

| | | | |
|---|---|---|---|
| 3,180,378 | 4/1965 | Carlton | 83/834 |
| 3,929,049 | 12/1975 | Graversen | 83/833 X |
| 3,977,288 | 8/1976 | Goldblatt et al. | 83/834 X |
| 4,408,393 | 10/1983 | Jerabek | 83/833 X |

*Primary Examiner*—Frank T. Yost

*Attorney, Agent, or Firm*—Browdy and Neimark

[57] ABSTRACT

A chain with cutting teeth wherein a width of a gauge of a drive link is reduced, and a ratio of a set to a height of cutting teeth of a cutter link is below 0.55.

6 Claims, 1 Drawing Figure

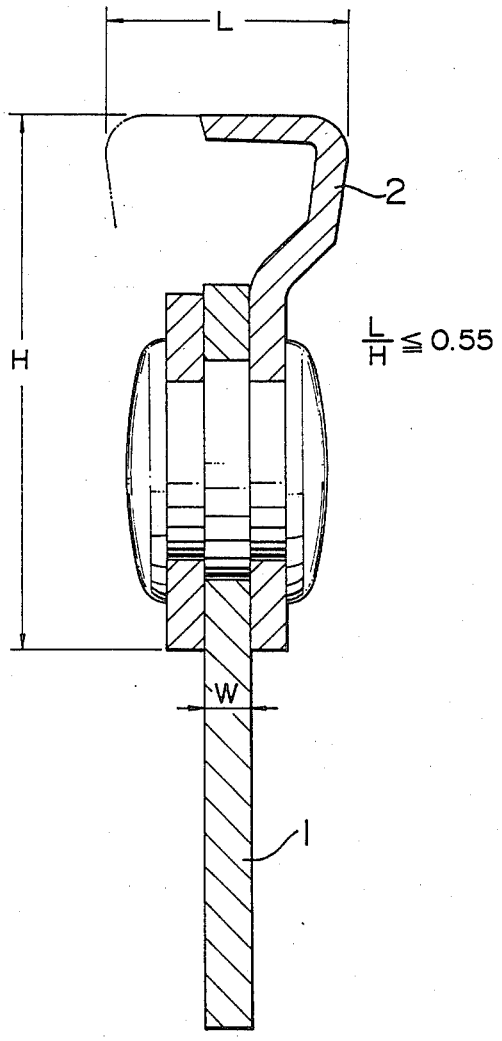
L
2
H
$\frac{L}{H} \leqq 0.55$
W
1

CHAIN WITH CUTTING TEETH

BACKGROUND OF THE INVENTION

1. Field of the Invention

This invention relates to a chain with cutting teeth suitable for use with a chain saw for cutting trees and the like.

2. Description of the Prior Art

In chains with cutting teeth of the prior art, it has hitherto been usual practice, when they are used with chain saws of small size and low horse power, to keep a width W of a gauge of a drive link and a ratio R of a set L to a height H of teeth of cutter links at 1.27 mm (0.050 in) and in a range between 0.6 and 0.7, respectively, while reducing the pitch of the chain, so as to enable to chain saws of low horse power to operate the chains smoothly.

When a chain with cutting teeth of the aforesaid construction of the prior art was used with the chain saw of low horse power, a sawing speed dropped. A reduction in pitch inevitably lessens the size of the drive link, resulting in an increase in the incidence of a dislodging of the chain. Thus, a problem arose that there is a limit to reducing the chain pitch, to enable the chain to be used with a chain saw of low horse power. Thus, it has become rare to use a chain pitch of below 0.325 in for practical purposes.

SUMMARY OF THE INVENTION

Object of the Invention

This invention has as its object the provision of a chain with cutting teeth which obviates the aforesaid problem of the prior art that there is a limit to reducing the chain pitch to enable the chain to be used with a chain saw of low horse power.

STATEMENT OF THE INVENTION

The outstanding characteristic of the invention is that the width W of the gauge of a drive link is reduced without changing the chain pitch and the ratio R of the set L to the height H of the cutting teeth of a cutter link is below 0.55.

The chain with cutting teeth according to the invention enables power required to operate the chain to be greatly reduced while keeping pressure applied to the drive link and other parts at substantially the same level as that applied thereto in chains with cutting teeth of the prior art.

The invention enables power required for oprating the chain to be greatly reduced while permitting the sawing speed to be kept at a high level, making it possible to reduce the size and weight of an engine for driving the chain. Together with a reduction in the weight of a chain guide bar and the chain, this enables a reduced overall weight to be obtained in a chain saw. The chain with cutting teeth according to the invention can be readily fabricated with finishes of a high degree of precision by means of a press because the material used is small in thickness.

BRIEF DESCRIPTION OF THE DRAWING

The single drawing is a vertical sectional view of the chain with cutting teeth comprising one embodiment of the invention.

DESCIPTION OF THE PREFERRED EMBODIMENT

The single drawing illustrates one embodiment of the chain with cutting teeth in conformity with the invention, comprising a drive link 1 and a tooth 2 of a cutter link. In the embodiment of the invention, the pitch of the chain is the same (0.0325 in, for example) as that of chains of the prior art. However, the width W of the gauge of the drive link 1 is 0.030 in (0.76 mm) which is smaller than the 0.050 in (1.27 mm) of drive links of the prior art. The ratio R of the set L to the height H of the cutting teeth of the cutter link is below 0.55 (0.44, for example). Whereas the set L of chains of the prior art is about 0.276 in (7 mm), the set L of the chain of the embodiment shown and described herein is about 0.157 in (4 mm) which is about 57% of the value of the prior art. Experiments conducted on the chain with cutting teeth according to the invention show that power required for cutting trees is reduced to about 60% of that required by the chain of the prior art in achieving the same results. It has also been shown that there is no appreciable drop in sawing speed and that the chain is free from the trouble of being dislodged from its position.

In the chain according to the invention, the pitch of the chain is not reduced as compared with that of the chains of the prior art. As a result, the chain according to the invention has a smaller number of cutter links than the chains of same length of the prior art, so that it is possible to economize on labor cost for setting of the cutting teeth.

What is claimed is:

1. A chain with cutting teeth wherein a width W of a gauge of a drive link is less than 0.050 in. and a ratio R of set L to height H of a cutter link is less than 0.55.

2. A chain with cutting teeth as claimed in claim 1, wherein the width W of the gauge of the drive link is about 0.030 in and the set L is about 0.157 in.

3. The chain of claim 1, having a pitch of about 0.035 in.

4. The chain of claim 3, said width W being about 0.030 in.

5. The chain of claim 1, said width W being about 0.030 in.

6. The chain of claim 1, wherein said set L is about 0.157 in.

* * * * *